US007955518B2

(12) United States Patent
Keller et al.

(10) Patent No.: US 7,955,518 B2
(45) Date of Patent: Jun. 7, 2011

(54) METHOD FOR HYDROPHOBING TEXTILE MATERIALS

(75) Inventors: Harald Keller, Ludwigshafen (DE); Juergen Reichert, Limburgerhof (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 12/826,117

(22) Filed: Jun. 29, 2010

(65) Prior Publication Data

US 2010/0305256 A1 Dec. 2, 2010

Related U.S. Application Data

(63) Continuation of application No. 10/544,780, filed as application No. PCT/EP2004/000776 on Jan. 29, 2004, now Pat. No. 7,790,238.

(30) Foreign Application Priority Data

Feb. 18, 2003 (DE) ..... 103 06 893

(51) Int. Cl.
*D06M 15/643* (2006.01)

(52) U.S. Cl. ..... 252/8.61; 252/8.81

(58) Field of Classification Search ..... 427/412; 252/8.61, 8.81
See application file for complete search history.

(56) References Cited

U.S. PATENT DOCUMENTS

| | | | | |
|---|---|---|---|---|
| 2,592,069 | A | 4/1952 | Reid | |
| 2,642,416 | A | 6/1953 | Ahlbrecht et al. | |
| 2,732,370 | A | 1/1956 | Codding | |
| 3,239,557 | A | 3/1966 | Fasick | |
| 3,354,022 | A | 11/1967 | Dettre et al. | |
| 3,462,296 | A | 8/1969 | Raynolds et al. | |
| 3,940,359 | A | 2/1976 | Chambers | |
| 2005/0066448 | A1 * | 3/2005 | Waeber et al. | 8/115.51 |

FOREIGN PATENT DOCUMENTS

| | | |
|---|---|---|
| EP | 0 666 349 | 8/1995 |
| EP | 0 761 696 | 3/1997 |
| EP | 0 933 388 | 8/1999 |
| EP | 1 283 296 | 2/2003 |
| GB | 1 118 007 | 6/1968 |
| JP | 62-156362 | 7/1987 |
| JP | 05-064735 | 3/1993 |
| WO | 96/04123 | 2/1996 |
| WO | 97/00995 | 1/1997 |
| WO | 01/75216 | 10/2001 |
| WO | 02/084013 | 10/2002 |

OTHER PUBLICATIONS

Kim, Jung-Hyun; Lee, Doug-Youn; Shin, Jin-Sup; Preparation of ethylene-modified latex using ethylene-acrylic acid resin; Nov. 14, 2000; Wiley-VCH; Macramolecular Symposia, vol. 151, Issue 1; pp. 509-514.*

Lewin et al. "Chemical Processing of Fibers and Fabrics", Handbook of Fiber Science and Technology, vol. 2, part B, pp. 172, 178-182 1984.

Kim et al., "Preparation of Ethylene-Modified Latex Using Ethylene-Acrylic Acid Resin," Nov. 14, 2000; Wiley-VCH, Macromolecular Symposia, vol. 151, Issue 1, pp. 509-514.

* cited by examiner

*Primary Examiner* — Michael Barr
*Assistant Examiner* — Robert S Walters, Jr.
(74) *Attorney, Agent, or Firm* — Oblon, Spivak, McClelland, Maier & Neustadt, L.L.P.

(57) ABSTRACT

The process for finishing textile materials by treatment with at least one aqueous liquor which comprises at least one organic polymer and at least one organic or inorganic solid in particulate form, wherein the organic or inorganic solid or solids are present in the liquor in a fraction of at least 5.5 g/l.

5 Claims, No Drawings

METHOD FOR HYDROPHOBING TEXTILE MATERIALS

The present invention relates to a process for finishing textile materials by treatment with at least one aqueous liquor which comprises at least one organic polymer and at least one organic or inorganic solid in particulate form, wherein the organic or inorganic solid or solids are present in the liquor in a fraction of at least 5.5 g/l.

The finishing of textiles is a field of growing commercial importance. It is particularly interesting to finish textiles to render them water and soil repellent. Modern measures utilize in some cases the so-called Lotus-Effect® and confer water-repellent performance on textiles by applying a rough surface.

WO 96/04123 describes self-cleaning surfaces which have an artificial surface structure which has elevations and depressions, the structure being characterized by its structural parameters in particular. The structures are prepared for example by embossing a structure onto a thermoplastically formable hydrophobic material or by applying Teflon powder to a surface which has been treated with UHU®. U.S. Pat. No. 3,354,022 discloses similarly prepared water-repellent surfaces.

EP-A 0 933 388 discloses processes for preparing structured surfaces that comprise first preparing a negative mold by photolithography, using this mold to emboss a plastics film and then hydrophobicizing the embossed plastics film with fluorinated alkylsilanes.

However, the methods described above are unsuitable for soil- and water-repellent finishing of textiles.

WO 02/84013 proposes hydrophobicizing fibers, composed of polyester for example, by pulling them through a hot decalin bath at 80° C. in which 1% of Aerosil® 8200 hydrophobicized silica gel has been suspended.

WO 02/84016 proposes hydrophobicizing woven polyester fabric by pulling it through a bath of hot DMSO (dimethyl sulfoxide) at 50° C. in which 1% of Aeroperl® 8200 hydrophobicized silica gel has been suspended.

The two hydrophobicization methods have the common feature that the solvent is selected such that the fibers are partially dissolved. This requires using large amounts of organic solvent, and this is undesirable in many cases. Moreover, treatment with organic solvents can have an effect on fiber mechanical properties.

WO 01/75216 proposes rendering textile fibers and fabrics water and soil repellent by providing them with a two-component layer, of which one is a dispersion medium and the other is a colloid for example. The finishing process described in WO 01/75216 provides finishing layers in which the colloids are anisotropically dispersed in the dispersion medium in that the colloids are observed to become concentrated at the boundary layer between the finishing layer and the surrounding surface. The process utilizes finishing liquors which contain up to 5 g/l of Aerosil 812 S.

However, textiles finished by the process described in WO 01/75216 lack satisfactory mechanical strength in many cases.

It is an object of the present invention to provide a process for finishing textile materials which is free of the above-indicated disadvantages and which also provides a very good water- and soil-repellent performance. It is a further object of the present invention to provide soil- and water-repellent textiles. It is a further object of the present invention to provide liquors for soil- and water-repellent finishing of textile materials.

We have found that this object is achieved by the process defined at the beginning.

Textile materials for the purposes of the present invention are fibers, roving, yarn, thread on the one hand and textile fabrics on the other such as for example wovens, knits, nonwovens and garments. Particular preference is given to textile fabrics used for manufacturing outdoor textiles for example. Examples are sails, umbrellas, tarpaulins, groundsheets, tablecloths, awnings and furniture covers for example for chairs, swings or benches.

Textile materials for the purposes of the present invention can consist of different substances. Examples are natural fibers and synthetic fibers and also blend fibers. Examples of natural fibers are silk, wool and cotton. Examples of synthetic fibers are polyamide, polyester, polypropylene, polyacrylonitrile, polyethylene terephthalate and viscose. Similarly, modified natural fibers can be coated according to the process of the present invention, for example cellulose acetate.

The process of the present invention utilizes at least one aqueous liquor. Aqueous liquor for the purposes of the present invention comprehends liquors which may comprise at least 5% by weight of water. The water content of aqueous liquors is preferably at least 25% by weight, more preferably at least 50% by weight and most preferably at least 75% by weight. The maximum water content is 99% by weight, preferably 97% by weight and more preferably 95% by weight.

Aqueous liquors used in this invention can comprise organic solvents, for example methanol, ethanol, isopropanol, acetone, methyl ethyl ketone, methyl isobutyl ketone, ethylene glycolmono-n-butyl ether, ethylene glycol monoisobutyl ether, acetic acid, n-butanol, isobutanol, n-hexanol and isomers, n-octanol and isomers, n-dodecanol and isomers, as well as water. Organic solvents can account for 1-50% by weight and preferably 2-25% by weight of the aqueous liquor used in this invention.

At least one of the liquors used in the process of this invention comprises at least one organic polymer. Organic polymers can serve as a binder. The action of a binder can be brought about for example by the organic polymer forming a film which binds the particles to each other and to the textile material to be coated.

In one embodiment of the present invention, at least one organic polymer comprises polymers or copolymers of ethylenically unsaturated hydrophobic monomers which have a 25° C. solubility in water of less than 1 g/l. In copolymers, hydrophobic monomers account for at least 50% by weight and preferably at least 75% by weight of the copolymer.

Preferred monomers are selected from the groups of the $C_2$-$C_{24}$-olefins, especially α-olefins of 2 to 24 carbon atoms, for example ethylene, propylene, 1-butene, isobutene, 1-hexene, 1-octene, 1-decene, 1-dodecene, 1-hexadecene or 1-octadecene;

styrenics, for example styrene, α-methylstyrene, cis-stilbene, trans-stilbene, diolefins such as for example 1,3-butadiene, cyclopentadiene, chloroprene or isoprene, $C_5$-$C_{18}$-cycloolefins such as for example cyclopentene, cyclohexene, norbornene, dimeric cyclopentadiene, vinyl esters of linear or branched $C_1$-$C_{20}$-alkanecarboxylic acids such as for example vinyl acetate, vinyl propionate, vinyl n-butyrate, vinyl n-hexanoate, vinyl n-octanoate, vinyl laurate and vinyl stearate, (meth)acrylic esters of $C_1$-$C_{20}$-alcohols, for example methyl (meth)acrylate, ethyl(meth)acrylate, n-propyl(meth)acrylate, isopropyl(meth)acrylate, n-butyl(meth)acrylate, isobutyl (meth)acrylate, tert-butyl(meth)acrylate, 2-ethylhexyl(meth) acrylate, n-octyl(meth)acrylate, n-decyl(meth)acrylate, n-dodecyl(meth)acrylate, n-eicosyl(meth)acrylate and most preferably from the groups of the halogenated monomers and the monomers having siloxane groups.

Halogenated monomers include chlorinated olefins such as for example vinyl chloride and vinylidene chloride.

Most particularly preferred halogenated monomers are fluorous olefins such as for example vinylidene fluoride, trifluorochloroethylene, tetrafluoroethylene, hexafluoropropylene, vinyl esters of fluorinated or perfluorinated $C_3$-$C_{11}$-carboxylic acids as described for example in U.S. Pat. No. 2,592,069 and U.S. Pat. No. 2,732,370 (meth)acrylic esters of fluorinated or perfluorinated alcohols such as for example fluorinated or perfluorinated $C_3$-$C_{14}$-alkyl alcohols, for example (meth)acrylate esters of HO—$CH_2$—$CH_2$—$CF_3$, HO—$CH_2$—$CH_2$—$C_2F_5$, HO—$CH_2$—$CH_2$-n-$C_3F_7$, HO—$CH_2$—$CH_2$-iso-$C_3F_7$, HO—$CH_2$—$CH_2$-n-$C_4F_9$, HO—$CH_2$—$CH_2$-n-$C_6F_{13}$, HO—$CH_2$—$CH_2$-n-$C_8F_{17}$, HO—$CH_2$—$CH_2$-n-$C_{10}F_{21}$, HO—$CH_2$—$CH_2$-n-$C_{12}F_{25}$, described for example in U.S. Pat. No. 2,642,416, U.S. Pat. No. 3,239,557, BR 1,118,007, U.S. Pat. No. 3,462,296.

Similarly, copolymers of for example glycidyl (meth)acrylate with esters of the formula I

I

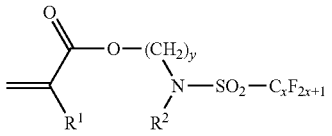

where:

$R^1$ is hydrogen, $CH_3$, $C_2H_5$, $R^2$ is $CH_3$, $C_2H_5$, x is an integer from 4 to 12 and most preferably from 6 to 8 y is an integer from 1 to 11 and preferably from 1 to 6, or glycidyl(meth)acrylate with vinyl esters of fluorinated carboxylic acids.

Useful copolymers further include copolymers of (meth) acrylic esters of fluorinated or perfluorinated $C_3$-$C_{12}$-alkyl alcohols such as for example HO—$CH_2$—$CH_2$—$CF_3$, HO—$CH_2$—$CH_2$—$C_2F_5$, HO—$CH_2$—$CH_2$-n-$C_3F_7$, HO—$CH_2$—$CH_2$-iso-$C_3F_7$, HO—$CH_2$—$CH_2$-n-$C_4F_9$, HO—$CH_2$—$CH_2$-n-$C_5F_{11}$, HO—$CH_2$—$CH_2$-n-$C_6F_{13}$, HO—$CH_2$—$CH_2$-n-$C_7F_{15}$;

with (meth)acrylic esters of nonhalogenated $C_1$-$C_{20}$-alcohols, for example methyl(meth)acrylate, ethyl(meth)acrylate, n-butyl(meth)acrylate, n-propyl(meth)acrylate, 2-ethylhexyl (meth)acrylate, n-octyl(meth)acrylate, n-decyl(meth)acrylate, n-dodecyl(meth)acrylate, n-eicosyl(meth)acrylate.

An overview of suitable fluorinated polymers and copolymers is given for example in M. Lewin et al., Chemical Processing of Fibers and Fabrics, Part B, Volume 2, Marcel Dekker, New York (1984), pages 172 ff. and pages 178-182.

Further suitable fluorinated polymers are disclosed for example in DE 199 120 810. From the group of the olefins having siloxane groups there may be mentioned for example olefins of the general formulae II a to II c IIa

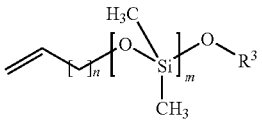

-continued

IIb

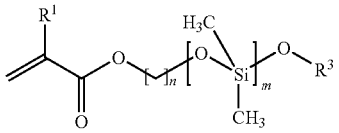

IIc

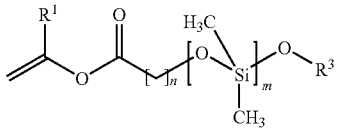

where:

$R^3$ is selected from $C_1$-$C_{18}$-alkyl, for example methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl, n-heptyl, isoheptyl, n-octyl, n-nonyl, n-decyl, n-dodecyl, n-tetradecyl, n-hexadecyl, n-octadecyl; preferably $C_1$-$C_6$-alkyl such as methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl, more preferably $C_1$-$C_4$-alkyl such as methyl, ethyl, n-propyl, isopropyl, n-butyl, iso-butyl, sec-butyl and tert-butyl and especially methyl.

$C_6$-$C_{14}$-Aryl, for example phenyl, 1-naphthyl, 2-naphthyl, 1-anthryl, 2-anthryl, 9-anthryl, 1-phenanthryl, 2-phenanthryl, 3-phenanthryl, 4-phenanthryl and 9-phenanthryl, preferably phenyl, 1-naphthyl and 2-naphthyl, more preferably phenyl $C_3$-$C_{12}$-cycloalkyl, for example cyclopropyl, cyclobutyl, cyclopentyl, cyclohexyl, cycloheptyl, cyclooctyl, cyclononyl, cyclodecyl, cycloundecyl and cyclododecyl; preference is given to cyclopentyl, cyclohexyl and cycloheptyl or $Si(CH_3)_3$.

$R^1$ is as defined above.

n is an integer from 0 to 6 and especially from 1 to 2;

m is an integer from 2 to 10 000 and especially up to 100.

Useful polymers further include: polyethers such as for example polyethylene glycol, polypropylene glycol, polybutylene glycols, polytetrahydrofuran; polycaprolactone, polycarbonates, polyvinyl butyral, partly aromatic polyesters formed from aliphatic or aromatic dicarboxylic acids and/or aliphatic or aromatic dialcohols, for example polyesters formed from aliphatic dialcohols having 2 to 18 carbon atoms such as for example ethylene glycol, propanediol, 1,4-butanediol, 1,6-hexanediol, 1,8-octanediol or bisphenol A, and aliphatic dicarboxylic acids having 3 to 18 carbon atoms such as for example succinic acid, glutaric acid, adipic acid and α,□-decanedicarboxylic acid; polyesters formed from terephthalic acid and aliphatic dialcohols having 2 to 18 carbon atoms such as for example ethylene glycol, propanediol, 1,4-butanediol, 1,6-hexanediol or 1,8-octanediol.

Polyesters mentioned above can be terminated for example with monoalcohols such as for example 4 to 12 carbon atoms, for example n-butanol, n-hexanol, n-octanol, n-decanol or n-dodecanol.

Polyesters mentioned above can be terminated for example with monocarboxylic acids such as for example stearic acid.

Useful polymers further include melamine-formaldehyde resins, urea-formaldehyde resins, N,N-dimethylol-4,5-dihydroxyethyleneureas which may be etherified with $C_1$-$C_5$ alcohols.

The molecular weight of the organic polymer or polymers can be selected within wide limits. The weight average molecular weight can be in the range from 1000 to 10 000 000 g/mol and preferably in the range from 2500 to 5 000 000 g/mol, determined by at least one of the following methods: light scattering, gel permeation chromatography (GPC), viscometry. When a polymer from the group of the polyolefins is used, for example polyethylene, polypropylene or polyisobutylene, and also copolymers of ethylene with propylene, butylene or 1-hexene, the molecular weight will advantageously be in the range from 30 000 to 5 000 000 g/mol.

The width of the molecular weight distribution is not critical as such and can be in the range from 1.1 to 20. It is customarily in the range from 2 to 10.

In one embodiment of the present invention, the fraction of the organic polymer or polymers described above is at least 0.1 g/l of the liquor, preferably at least 1 g/l and more preferably at least 10 g/l. The maximum fraction is for example 500 g/l, preferably 250 g/l and more preferably 100 g/l.

In one embodiment of the present invention, the organic polymer or polymers are not soluble in the liquor, not soluble meaning in the context of with organic polymers for the purposes of the present invention that the room temperature solubility in the liquor is less than 1 g/l and more preferably less than 0.1 g/l.

One embodiment of the present invention comprises using at least two different organic polymers.

In one embodiment of the present invention, at least one organic polymer can be present in the form of particles having a measure of central tendency particle diameter in the range from 0.1 to 50 μm, preferably from 0.5 to 30 μm and more preferably up to 20 μm (median value, number average).

At least one aqueous liquor used in the process of this invention comprises at least one hydrophobic solid in particulate form that differs from the polymer or polymers described above, in a fraction of at least 5.5 g/l, preferably at least 7 g/l and more preferably at least 10 g/l. When it is desired to use at least two hydrophobic solids in particulate form, then it is preferable for at least one to be present in a fraction of at least 5.5 g/l. The maximum fraction of the hydrophobic solid or solids in particulate form can be 150 g/l in total. The hydrophobic solid in particulate form can be inorganic or organic in nature; preferably, it is inorganic.

Examples of suitable materials are polyethylene, polypropylene, polyisobutylene and polystyrene and also copolymers thereof with each other or with one or more further olefins such as for example styrene, methyl acrylate, ethyl acrylate, methyl methacrylate, butyl acrylate, butyl methacrylate, 2-ethylhexyl acrylate, 2-ethylhexyl methacrylate, maleic anhydride or N-methylmaleimide. A preferred polyethylene or polypropylene is described for example in EP-A 0 761 696.

Particularly useful materials include inorganic materials, especially solid inorganic oxides, carbonates, phosphates, silicates or sulfates of groups 3 to 14 of the periodic table, for example calcium oxide, silicon dioxide or aluminum oxide, calcium carbonate, calcium sulfate or calcium silicate, of which aluminum oxide and silicon dioxide are preferred. Particular preference is given to silicon dioxide in its silica gel form. Very particular preference is given to pyrogenic silica gels. Solid inorganic oxides can be hydrophobicized thermally by heating to 400-800° C. or preferably through physisorbed or chemisorbed organic or organometallic compounds. For this, particles are reacted prior to the coating step with, for example, organometallics which comprise at least one functional group, for example alkyllithium compounds such as methyllithium, n-butyllithium or n-hexyllithium; or silanes such as for example hexamethyldisilazane, octyltrimethoxysilane and especially halogenated silanes such as trimethylchlorosilane or dichlorodimethylsilane.

Hydrophobic in the context of the hydrophobic solid or solids in particulate form is to be understood as meaning that its solubility is below 1 g/l and preferably below 0.3 g/l (determined at room temperature).

Inorganic solids can preferably be porous in nature. The porous structure is best characterized in terms of the BET surface area measured in accordance with German standard DIN 66131. Inorganic solids used can preferably a BET surface area in the range from 5 to 1000 $m^2/g$, preferably in the range from 10 to 800 $m^2/g$ and more preferably in the range from 20 to 500 $m^2/g$.

In one embodiment of the present invention, at least one of the hydrophobic solids is present in particulate form. The measure of central tendency particle diameter (median value, number average) is at least 1 nm, preferably at least 3 nm and more preferably at least 6 nm. The maximum particle diameter (median value, number average) is 350 nm and preferably 100 nm. The particle diameter can be measured using commonly used methods such as for example transmission electron microscopy.

The weight ratio of organic polymer to organic or inorganic solid in particulate form is generally in the range from 9:1 to 1:9, preferably in the range from 4:1 to 1:4 and more preferably in the range from 7:3 to 4:6.

In one embodiment of the present invention, at least one of the hydrophobic solids is present in the form of spherical particles, which is intended to comprehend particulate solids where at least 75% by weight and preferably at least 90% by weight is present in spherical form while other particles are present in granular form.

In one embodiment of the present invention, at least one of the hydrophobic solids can form agglomerates. When one or more hydrophobic solids are present in the form of agglomerates, which can consist of from 2 to several thousand primary particles and which in turn can have a spherical form, the particulars concerning particle form and size relate to primary particles.

At least one liquor used in the process of this invention can comprise at least one surface-active agent selected for example from the group of the ionic and nonionic emulsifiers.

Useful nonionic emulsifiers include for example ethoxylated mono-, di- and trialkylphenols (degree of ethoxylation: 3-50, alkyl radical: $C_4$-$C_{12}$) and also ethoxylated fatty alcohols (degree of ethoxylation: 3-80; alkyl radical: $C_8$-$C_{36}$). Examples thereof are the Lutensol® grades from BASF Aktiengesellschaft or the Triton® grades from Union Carbide.

Useful anionic emulsifiers include for example alkali metal and ammonium salts of alkyl sulfates (alkyl radical: $C_8$-$C_{12}$), of sulfuric monoesters of ethoxylated alkanols (degree of ethoxylation: 4-30, alkyl radical: $C_{12}$-$C_{18}$) and of ethoxylated alkylphenols (degree of ethoxylation: 3-50, alkyl radical: $C_4$-$C_{12}$), of alkylsulfonic acids (alkyl radical: $C_{12}$-$C_{18}$) and of alkylarylsulfonic acids (alkyl radical: $C_9$-$C_{18}$).

Useful cationic emulsifiers are generally $C_6$-$C_{18}$-alkyl-, $C_6$-$C_{18}$-aralkyl- or heterocyclyl-containing primary, secondary, tertiary or quaternary ammonium salts, alkanolammonium salts, pyridinium salts, imidazolinium salts, oxazolinium salts, morpholinium salts, thiazolinium salts and also salts of amine oxides, quinolinium salts, isoquinolinium salts, tropylium salts, sulfonium salts and phosphonium salts. Examples which may be mentioned are dodecylammonium acetate or the corresponding hydrochloride, the chlorides or acetates of the various 2-(N,N,N-trimethylammonium)ethyl paraffinic acid esters, N-cetylpyridinium chloride, N-laurylpyridinium sulfate and also N-cetyl-N,N,N-trimethylammonium bromide, N-dodecyl-N,N,N-trimethylammonium bromide, N,N-distearyl-N,N-dimethylammonium chloride and also the Gemini surfactant N,N-(lauryldimethyl)ethylenediamine dibromide. Numerous further examples may be found in H. Stache, *Tensid-Taschenbuch*, Carl-Hanser-Verlag, Munich, Vienna, 1981 and in McCutcheon's, *Emulsifiers & Detergents*, MC Publishing Company, Glen Rock, 1989.

Very particularly suitable emulsifiers include for example copolymers of ethylene and at least one α,β-unsaturated mono- or dicarboxylic acid or at least one anhydride of an α,β-unsaturated mono- or dicarboxylic acid, for example acrylic acid, methacrylic acid, crotonic acid, maleic acid, fumaric acid, methylenemalonic acid, maleic anyhdride, itaconic anhydride. The carboxyl groups can be partly or preferably wholly neutralized, for example with alkali metal ions, alkaline earth metal ions, ammonium or amines, for example amines such as triethylamine, diethylamine, ethylamine, trimethylamine, dimethylamine, methylamine, ethyldiisopropylamine, ethanolamine, diethanolamine, triethanolamine, N-methyldiethanolamine, N-(n-butyl)diethanolamine or N,N-dimethylethanolamine.

The fraction of emulsifier in the liquor can be chosen within wide limits and can be in the range from 0.1 to 100 g/l, preferably in the range from 0.2 to 10 g/l.

The process of the present invention is carried out by treating textile material with at least one aqueous liquor. It is possible to carry out plural treatment steps with identical or different liquors.

In one embodiment of the present invention, the process of the present invention comprises treating the textile first with a liquor which contains at least one organic polymer and further an organic or preferably inorganic solid in particulate form and subsequently with a new liquor which comprises the organic polymer but no further organic or inorganic solid in particulate form.

In one embodiment of the present invention, the process of the present invention comprises treating the textile first with a liquor which comprises at least one organic polymer and further an organic or preferably inorganic solid in particulate form and subsequently with a new liquor which comprises another organic polymer but no further organic or inorganic solid in particulate form.

In one embodiment of the present invention, the process of the present invention comprises treating the textile first with a liquor which comprises at least one organic polymer and further an organic or preferably inorganic solid in particulate form and subsequently with a new liquor which comprises no further polymer but does comprise the inorganic solid in particulate form already used in the first step.

The temperature at which the process of the present invention is carried out is as such not critical. The liquor temperature can be in the range from 10 to 60° C., preferably in the range from 15 to 30° C.

The process parameters for the process of the present invention can be chosen such that the process of the present invention will produce a wet pickup which is typically in the range from 25% by weight to 85% by weight and preferably in the range from 40% to 70% by weight.

The process of the present invention can be carried out in machines commonly used for the finishing of textiles, for example pad-mangles. Preference is given to vertical textile feed pad-mangles, where the essential element is two rolls in press contact with each other, through which the textile is led. The liquor is filled in above the rolls and wets the textile. The pressure causes the textile to be squeezed off and ensures a constant add-on.

In one embodiment of the present invention, the speed of the pad-mangle textile feed is in the range from 1 to 40 m/min and preferably in the range from 1 to 30 m/min.

The treated textile after the treatment according to this invention can be dried by methods customary in the textile industry.

The treatment according to the present invention can be followed by a heat treatment, which can be operated continuously or batchwise. The duration of the heat treatment can be chosen within wide limits. The heat treatment can typically be carried out for from about 10 seconds to about 30 minutes, especially from 30 seconds to 5 minutes. The heat treatment is carried out by heating to temperatures of up to 180° C., preferably up to 150° C. It is of course necessary to adapt the temperature of the heat treatment to the sensitivity of the fabric.

An example of a suitable method of heat treatment is hot air drying.

In one embodiment of the present invention, the textile material is provided with a bonding layer prior to the treatment according to the present invention. The bonding layer can be provided using a primer. The application of a primer is preferable when synthetic dyed fibers are to be finished.

In one embodiment of the present invention, the bonding layer applied to the textile material to be treated can be for example one or more polymers, in which case the polymer synthesis can also be carried out on the textile material. Particularly useful polymers have crosslinked or crosslinking-capable groups, for example natural or synthetic polymers having free hydroxyl groups, carbonyl groups, primary or secondary amino groups or thiol groups. Examples of very useful polymers are lignin, polysaccharides, polyvinyl alcohols and polyethyleneimine. Crosslinking can be accomplished for example by subsequent reaction with for example isocyanates, dimethylolurea or N,N-dimethylol-4,5-dihydroxyethyleneurea (DMDHEU). Other particularly preferred crosslinkers are melamine-formaldehyde resins, which can have been etherified with methanol.

In another embodiment, when polyesters or polyamides are to be treated, from 0.01% to 1% by weight and preferably from 0.1 to 0.5% by weight of the textile is saponified by partial saponification with strong alkalis such as aqueous sodium hydroxide solution or potassium hydroxide solution.

The present invention further provides textile materials finished according to the process of the present invention. Finishing according to the present invention provides the textiles of the present invention with one or more coats. The textile materials of the present invention exhibit particularly good soil- and water-repellent performance. Textile materials according to the present invention further exhibit very good mechanical strength. In the textile materials coated according to the present invention, the solid or solids used are isotropically or substantially isotropically distributed throughout the finishing coat, i.e., no concentration is observed in the boundary layer between the finishing coat and the surrounding atmosphere.

In one embodiment, the textiles of the present invention comprise from 0.5 to 50 g/m$^2$ of coating, preferably from 1 to 20 g/m$^2$ and more preferably from 1.5 to 10 g/m$^2$.

The present invention further provides aqueous liquors for finishing textile materials that comprise at least one organic polymer and at least one organic or inorganic solid in particulate form, wherein the organic or inorganic solids are present in the liquor in a fraction of at least 5.5 g/l. The liquors of the present invention can comprise further components, for example one or more organic solvents or one or more emulsifiers.

The present invention further provides for the use of the liquors of the present invention for finishing textile materials.

The present invention further provides a process for preparing aqueous liquors, hereinafter also referred to as preparation process of the present invention. The preparation process of the present invention comprises the mixing of the following components:

at least one organic polymer, at least one organic or inorganic solid in particulate form, water, and optionally one or more organic solvents, and optionally further components, for example one or more emulsifiers, wherein the amount of organic or inorganic solid in particulate form is chosen such that the organic or inorganic solid in particulate form is present in the aqueous liquor in a fraction of at least 5.5 g/l.

The preparation process of the present invention can customarily be carried out at temperatures ranging from room temperature up to about 100° C., room temperature being preferred.

The preparation process of the present invention comprises in general a homogenizing step, for example by mechanical or pneumatic stirring, shaking, ultrasonication or a combination thereof. In some cases, however, the homogenizing step can be dispensed with.

The order in which the components are added is in principle freely choosable. For instance, the first step can be to prepare a water- and solvent-free mixture of polymer and organic or inorganic solid and then to disperse the dry mixture in organic solvent or mixture of water and organic solvent or in water.

In one embodiment of the preparation process of the present invention, the initial step is to prepare formulations which comprise the organic polymer, organic or inorganic solid in particulate form, optionally one or more organic solvents and optionally one or more emulsifiers and also optionally water. Prior to performing the treatment of textile materials in a manner according to the present invention, a liquor which is in accordance with the present invention is then prepared by diluting the formulation with water. It is preferable that the formulations of the present invention comprise not more than 15% by weight, preferably about 0.1-10% by weight, and more preferably up to 5% by weight of water. The formulations of the present invention can also be water-free.

The present invention further provides formulations which comprise organic polymer, organic or inorganic solid in particulate form, optionally one or more organic solvents and optionally one or more emulsifiers and also optionally water, the fraction of water being in the range from about 0.1% to 10% by weight and preferably about 5% by weight.

The examples which follow illustrate the invention.

EXAMPLE 1

Preparation of Inventive Liquors

EXAMPLE 1.1

Preparation of Liquor 1.1

The following were mixed in a flask by mechanical stirring:

883.5 ml of demineralized water, 62.4 g of an aqueous dispersion (solids content 20% by weight) of a random copolymer formed from 10% by weight of methacrylic acid and 90% by weight of $CH_2{=}C(CH_3)COO{-}CH_2{-}CH_2\text{-n-}C_8F_{17}$ and having $M_n$ 3000 g/mol (gel permeation chromatography), 15.6 g of an aqueous dispersion (solids content 20% by weight) of a random copolymer formed from 20% by weight of acrylic acid, 80% by weight of ethylene, $M_w$: 20 000 g/mol, neutralized with N,N-dimethylethanolamine, pH between 8.5 and 9.5, and 25.2 g of isopropanol.

Then 13.3 g of dimethylsiloxane-modified pyrogenic silica having a BET surface area of 225 $m^2/g$, determined in accordance with German standard DIN 66131, primary particle diameter: 10 nm (median value, number average) were added and dispersed in the mix for 10 minutes (Ultraturrax stirrer) to give the aqueous liquor 1.1.

EXAMPLE 1.2

Preparation of Liquor 1.2

The following were mixed in a flask by mechanical stirring:

899.5 ml of demineralized water, 52.4 g of an aqueous dispersion (solids content 20% by weight) of a random copolymer formed from 10% by weight of methacrylic acid and 90% by weight of $CH_2{=}C(CH_3)COO{-}CH_2{-}CH_2\text{-n-}C_6F_{13}$ and having $M_n$ 2900 g/mol (gel permeation chromatography), 14.6 g of an aqueous dispersion (solids content 20% by weight) of a random copolymer formed from 20% by weight of acrylic acid, 80% by weight of ethylene, $M_w$: 20 000 g/mol, neutralized with N,N-dimethylethanolamine, pH between 8.5 and 9.5, and 25.2 g of isopropanol.

Then 8.3 g of trimethylsiloxane-modified pyrogenic silica having a BET surface area of 200 $m^2/g$ were determined in accordance with German standard DIN 66131, were added, primary particle size: 10 nm (median value, number average), and dispersed in the mix for 10 minutes (Ultraturrax stirrer) to give the aqueous liquor 1.2.

EXAMPLE 1.3

Preparation of Liquor 1.3

The following were mixed in a flask by mechanical stirring:

884.5 ml of demineralized water, 66.3 g of an aqueous dispersion (solids content 20% by weight) of a random copolymer formed from 10% by weight of methacrylic acid and 90% by weight of $CH_2{=}C(CH_3)COO{-}CH_2{-}CH_2\text{-n-}C_8F_{17}$ and having $M_n$ 3000 g/mol (gel permeation chromatography), 13.8 g of an aqueous dispersion (solids content 20% by weight) of a random copolymer formed from 20% by weight of acrylic acid, 80% by weight of ethylene, $M_w$: 20 000 g/mol, neutralized with N,N-dimethylethanolamine, pH between 8.5 and 9.5, and 30.2 g of isopropanol mixed by mechanical stirring.

Then 5.2 g of dimethylsiloxane-modified pyrogenic silica having a BET surface area of 225 $m^2/g$, determined in accordance with German standard DIN 66131, primary particle diameter: 10 nm (median value, number average) were added and dispersed in the mix for 10 minutes (Ultraturrax stirrer) to give the aqueous liquor 1.3.

EXAMPLE 1.4

Preparation of Liquor 1.4

The following were mixed in a flask by mechanical stirring:

886.3 ml of demineralized water, 20.8 g of an aqueous dispersion (solids content 20% by weight) of a random copolymer formed from 10% by weight of methacrylic acid and 90% by weight of $CH_2{=}C(CH_3)COO{-}CH_2{-}CH_2{-}n{-}C_6F_{13}$ and having $M_n$ 3000 g/mol (gel permeation chromatography), 57 g of an aqueous dispersion (solids content 20% by weight) of a random copolymer formed from 20% by weight of acrylic acid, 80% by weight of ethylene, $M_w$: 25 000 g/mol, neutralized with N,N-dimethylethanolamine, pH between 8.5 and 9.5, and 28.4 g of isopropanol.

Then 7.5 g of dimethylsiloxane-modified pyrogenic silica having a BET surface area of 225 $m^2/g$, determined in accordance with German standard DIN 66131, were added, primary particle size: 10 nm (median value, number average), and dispersed in the mix for 10 minutes (Ultraturrax stirrer) to give the aqueous liquor 1.4.

EXAMPLE 2

Textile Finishing

EXAMPLE 2.1

A woven polyester fabric having a basis weight of 220 $g/m^2$ was treated with liquor 1.1 on a pad-mangle from Mathis (model HVF12085). The squeeze pressure of the rolls was 2.6 bar. This produced a wet pickup of 60%. The application speed was 2 m/min. The treated polyester fabric was subsequently dried on a tenter at 120° C. The conclusive heat treatment took 3 min at 150° C. with circulating air. The treated polyester fabric 2.1 was obtained.

EXAMPLE 2.2

A woven polyamide fabric having a basis weight of 160 $g/m^2$ was treated with liquor 1.1 on a pad-mangle from Mathis (model HVF12085). The squeeze pressure of the rolls was 2.6 bar. This produced a wet pickup of 65%. The application speed was 2 m/min. The treated polyamide fabric was subsequently dried on a tenter at 120° C. The conclusive heat treatment took 3 min at 150° C. with circulating air. The treated polyamide fabric 2.2 was obtained.

EXAMPLE 2.3

A woven polyacrylic fabric having a basis weight of 295 $g/m^2$ was treated with liquor 1.1 on a pad-mangle from Mathis (model HVF12085). The squeeze pressure of the rolls was 2.6 bar. This produced a wet pickup of 50%. The application speed was 2 m/min. The treated polyacrylic fabric was subsequently dried on a tenter at 120° C. The conclusive heat treatment took 3 min at 150° C. with circulating air. The treated polyester fabric 2.3 was obtained.

EXAMPLE 2.4

A woven polyester fabric having a basis weight of 220 $g/m^2$ was treated with liquor 1.2 on a pad-mangle from Mathis (model HVF12085). The squeeze pressure of the rolls was 2.6 bar. This produced a wet pickup of 60%. The application speed was 2 m/min. The treated polyester fabric was subsequently dried on a tenter at 120° C. The conclusive heat treatment took 3 min at 150° C. with circulating air. The treated polyester fabric 2.4 was obtained.

EXAMPLE 2.5

A woven polyamide fabric having a basis weight of 160 $g/m^2$ was treated with liquor 1.2 on a pad-mangle from Mathis (model HVF12085). The squeeze pressure of the rolls was 2.6 bar. This produced a wet pickup of 65%. The application speed was 2 m/min. The treated polyamide fabric was subsequently dried on a tenter at 120° C. The conclusive heat treatment took 3 min at 150° C. with circulating air. The treated polyamide fabric 2.5 was obtained.

EXAMPLE 2.6

A woven polyacrylic fabric having a basis weight of 295 $g/m^2$ was treated with liquor 1.2 on a pad-mangle from Mathis (model HVF12085). The squeeze pressure of the rolls was 2.6 bar. This produced a wet pickup of 50%. The application speed was 2 m/min. The treated polyacrylic fabric was subsequently dried on a tenter at 120° C. The conclusive heat treatment took 3 min at 150° C. with circulating air. The treated polyester fabric 2.6 was obtained.

3. Water Repellency Testing of Textile Samples Which Have Been Treated According to the Present Invention The textile sample which has been treated according to the present invention and is to be tested was manually tensioned and fixed with nails to a flat wooden board whose inclination was continuously adjustable in the range from 1° to 90°. A cannula was then used to drop individual water droplets onto the textile sample from a height of 10 mm. The droplets had a mass of 4.7 mg. The angle of inclination was incrementally increased to that angle of inclination at which the droplets were just starting to be beaded off and there was no sign of adhesion. The results are given in Table 1.

TABLE 1

| Angle of inclination | |
|---|---|
| Sample | Angle of inclination [°] |
| 2.1 | 5 |
| 2.2 | 3 |
| 2.3 | 6 |
| 2.4 | 7 |
| 2.5 | 6 |
| 2.6 | 8 |

We claim:

1. A formulation comprising an aqueous liquor comprising:

an organic polymer, an organic or inorganic solid in particulate form having a median (number average) particle diameter in the range from 1 nm to 350 nm, at least one emulsifier comprising at least one copolymer of ethylene and at least one of an α,β-unsaturated dicarboxylic acid, wherein the organic or inorganic solid is present in the aqueous liquor in a fraction of at least 5.5 g/l.

2. The formulation of claim 1, further comprising at least one organic solvent.

3. The formulation of claim 1, wherein water is present in an amount of not more than 15% by weight.

4. The formulation of claim 1, further comprising at least one organic solvent and, wherein water is present in an amount of not more than 15% by weight.

5. The formulation of claim 1, wherein the organic or inorganic solid is present in the aqueous liquor in a fraction of at least 7 g/l.

* * * * *